US007347773B2

(12) United States Patent
Parlade De Elia et al.

(10) Patent No.: US 7,347,773 B2
(45) Date of Patent: Mar. 25, 2008

(54) SILENCER FOR FUME EXTRACTING HOODS

(75) Inventors: Jorge Parlade De Elia, Vic (ES); Joan Casals Trave, Torelló (ES)

(73) Assignee: Cata Electrodomesticos, S.L. (ES)

( * ) Notice: Subject to any disclaimer, the term of this patent is extended or adjusted under 35 U.S.C. 154(b) by 58 days.

(21) Appl. No.: 10/552,347

(22) PCT Filed: Apr. 5, 2004

(86) PCT No.: PCT/ES2004/000153

§ 371 (c)(1),
(2), (4) Date: Oct. 7, 2005

(87) PCT Pub. No.: WO2004/090427

PCT Pub. Date: Oct. 21, 2004

(65) Prior Publication Data

US 2006/0237262 A1 Oct. 26, 2006

(30) Foreign Application Priority Data

Apr. 7, 2003 (ES) ..... 200300814

(51) Int. Cl.
*F23J 11/00* (2006.01)

(52) U.S. Cl. ..... 454/56; 454/49; 454/63

(58) Field of Classification Search ..... 454/49, 454/56, 61, 62, 63, 65
See application file for complete search history.

(56) References Cited

U.S. PATENT DOCUMENTS

| | | | | |
|---|---|---|---|---|
| 2,176,319 | A * | 10/1939 | Anderson | 454/236 |
| 3,455,378 | A * | 7/1969 | Honnold, Jr. | 165/135 |
| 3,978,919 | A * | 9/1976 | Fachbach et al. | 165/135 |
| 5,196,040 | A * | 3/1993 | Malloy et al. | 55/323 |
| 5,299,634 | A * | 4/1994 | Toyoda et al. | 165/135 |
| 5,512,073 | A * | 4/1996 | Mirza et al. | 55/323 |
| 6,428,408 | B1 * | 8/2002 | Bell et al. | 454/56 |

* cited by examiner

*Primary Examiner*—Derek S. Boles
(74) *Attorney, Agent, or Firm*—Evelyn A. Defilló; Defillo & Associates, Inc

(57) ABSTRACT

The silencer for fume extracting hoods is comprised of a panel (1) consisting of a lower tray (4), an insulating intermediary sheet (5), and an upper or porous filling foamed material (6) acting as a sound absorbing and limiting or damping material. The panel is hinged to the fume extracting hood (7) by articulation means (2).

3 Claims, 4 Drawing Sheets

FIG. 1
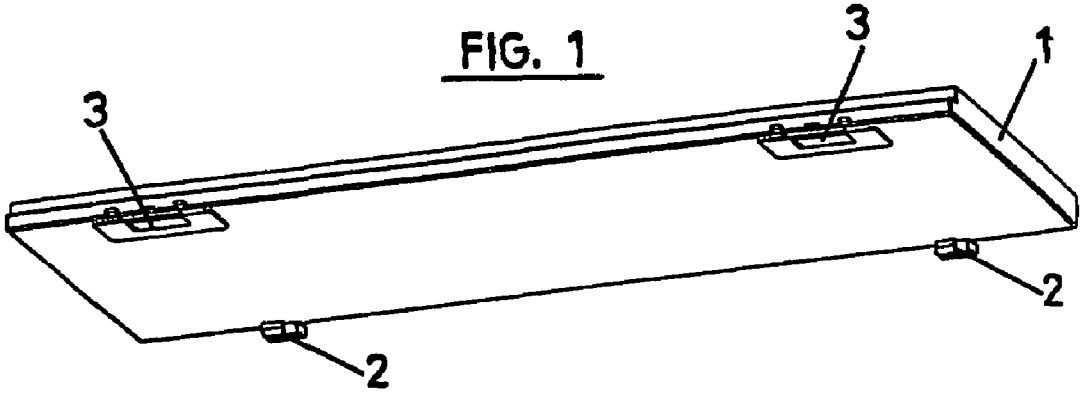
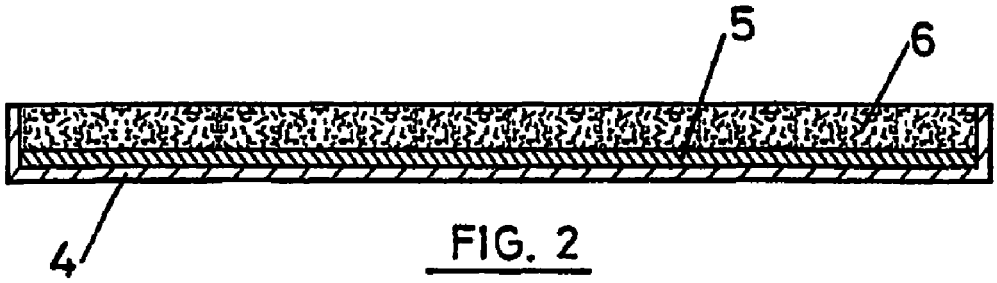
FIG. 2

SILENCER FOR FUME EXTRACTING HOODS

FIELD OF THE INVENTION

The present invention refers to a silencer for fume extracting hoods, destined to reduce noise produced by said hoods in the starting up of the intake fan. The invention also refers to the extracting hood that includes the mentioned silencer.

BACKGROUND OF THE INVENTION

The noise produced by the fume extracting hoods is originated by the fan and the vibrations which it's functioning may provoke. Generally, the hoods dispose of a control unit that permits to vary the speed of the fan, and thus the capacity of extraction, Depending on the type of the hood, be it of domestic or of industrial type, of the power of the fan and of the selected speed in each moment, it will depend on the noise produced.

For the amenity of the users it is desirable to eliminate or at least to reduce this noise. Therefore it is already known through the patent EP 0596846 to provide the hood with means for the active absorption of the sound, whose means consist of an acoustic sensor that measures the level of the noise, of a loudspeaker to emit a tone that silences a sound of the fan in inverse phase with itself, and of an electronic control unit connected to said sensor and loudspeaker and adapted to control the loudspeaker in response to the information received from the sensor. This set up is complicated and considerably increases the costs of the hood, apart from presenting problems of assembling and functioning.

SUMMARY OF THE INVENTION

The object of the present invention is to develop a silencer for fume extracting hoods that has a simple low-cost set up and, and whose assembly and disassembly can be carried out through simple and quick operations, without the need of a specialized manpower.

The invention also has as its object the fume extracting hood that includes the afore mentioned silencer.

According to the present invention the silencer is made up of a panel consisting of a lower tray, for example of metallic or plastic nature or of synthetic resin, etc., of an insulating intermediary sheet, and an upper layer of porous or filling foamed material acting as a sound absorbing or damping material.

According to another characteristic of the invention, the panel with the described composition will be of a more reduced contour that the inner one of the hood, being provided with fastening means inside said hood.

With the set up commented, the panel is assembled inside the hood. Being the panel of more reduced contour that the inner one of the hood, the edges of said panel will stay separated from the inner surface of the hood, delimitating with it some passages for the pass of the air taken in by the fan.

The panel will have in one of its edges or laterals some butt flat hinges for the junction to one of the laterals of the hood, whereas in one or more of the remaining edges it will have some catch levers or fixing latches. In this way the panel can be opened to the exterior, to permit access to the internal mechanisms of the hood.

With the panel of the invention it can be managed to considerably reduce the noise level produced by the functioning effect of the fan, as the upper layer of foamed material acts as a sound absorbing or damping material.

The level of the damping effect can be augmented by providing the internal wall tray that will delimit some partitions, in each one of which there is arranged the intermediary insulating sheet and the upper layer of the foamed material.

The lower tray will be preferably made up of a stainless material.

The set up of the silencer and hood, object of the invention, will be better understood with the following description, made with references to the attached drawings, in which there is shown an example of one non-limitative embodiment.

BRIEF DESCRIPTION OF THE DRAWINGS

In the drawings there is shown

FIG. 1 shows an inferior perspective view of a silencer for fume extracting hood constituted according to the present invention.

FIG. 2 shows a cross-section of the silencer of FIG. 1, in a greater scale.

DESCRIPTION OF THE INVENTION

Figure 3:
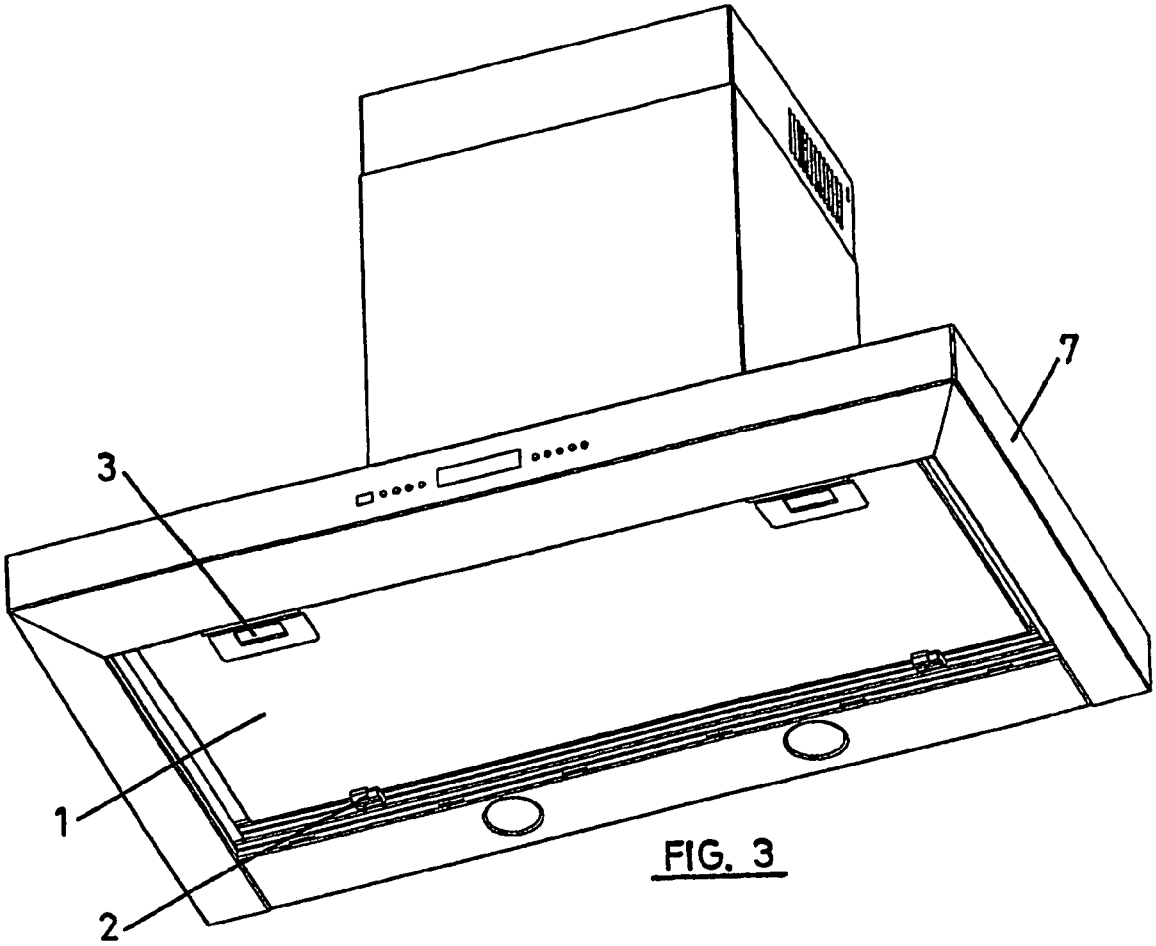
FIG. 3 shows an inferior perspective view of a fume extracting hood equipped with the silencer of FIGS. 1 and 2.

In FIG. 1 there is shown a silencer for fume extracting hoods, that consists of a panel 1 that has in one of its laterals some hinges 2 through which the interior surface of one of the walls of a fume extracting hood. In the opposite edge the panel 1 has latches or blocking studs 3 inside the hood, in order to fix to the panel 1 in an essentially horizontal position or to allow its opening to the exterior, thereby facilitating the access to the internal mechanisms of the hood.

As it can better be seen in the FIG. 2, the panel 1 is composed of an external tray 4 in whose internal surface there is arranged an insulating sheet 5 and above which the tray 4 is filled with a foamed or non woven material, or any other type of material that acts as a damper and an acoustic dump.

The so constituted panel 1 will have a more reduced contour than the internal one of the fume hoods.

Figure 4:
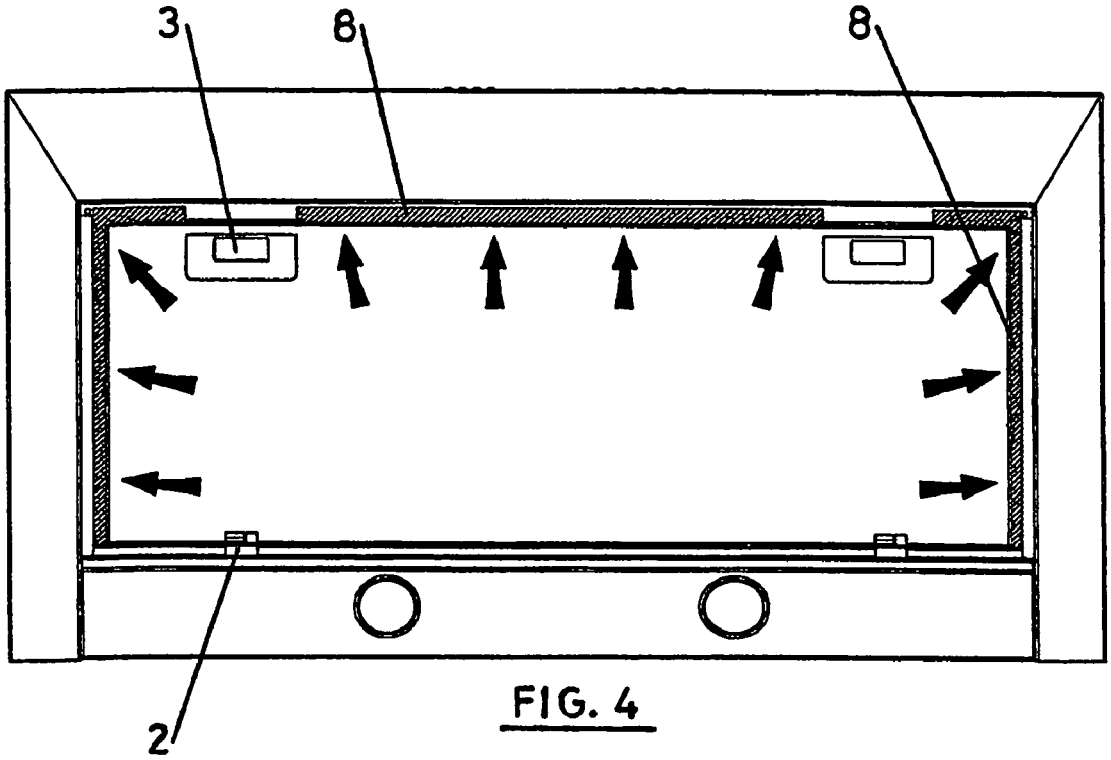
FIG. 4 shows an inferior flat view of the hood of FIG. 3.
Figure 6:
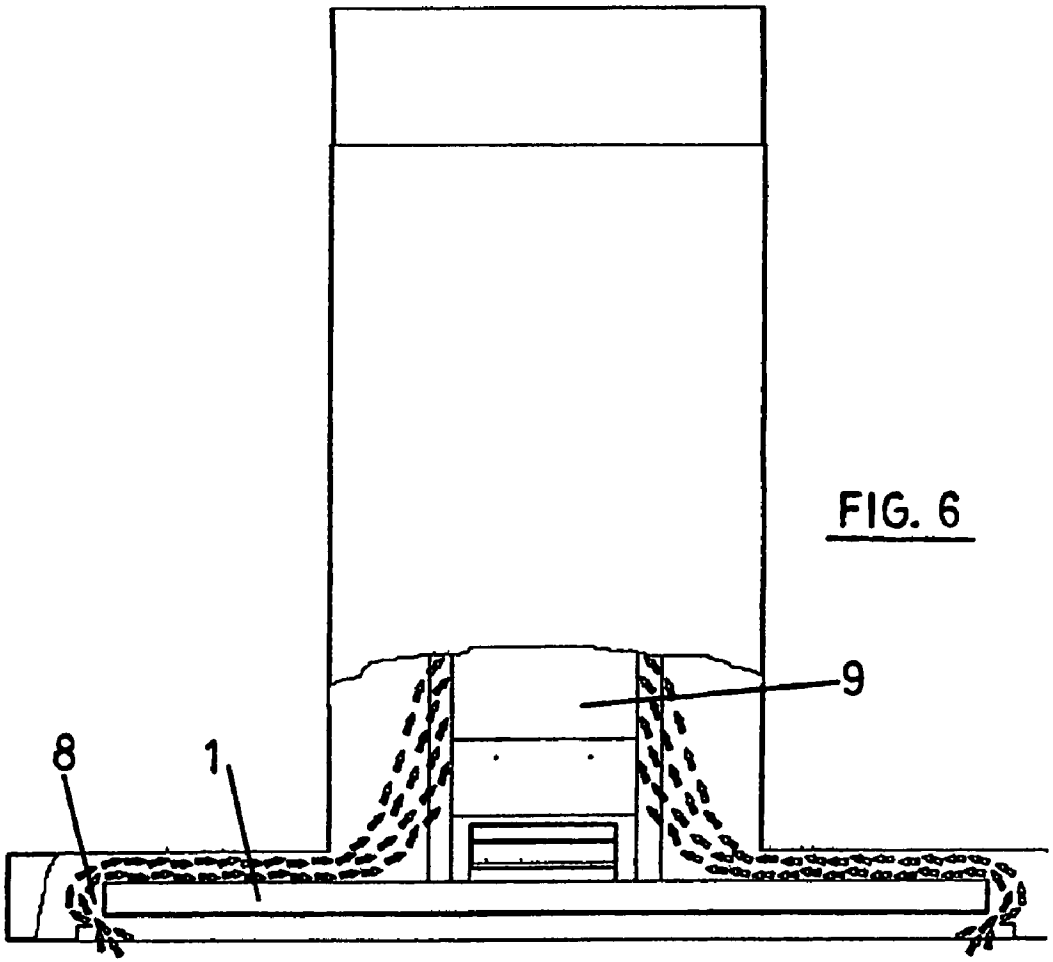
FIGS. 5 and 6 show a cross-section and a longitudinal section of the hoods of the FIGS. 3 and 4.
Figure 5:
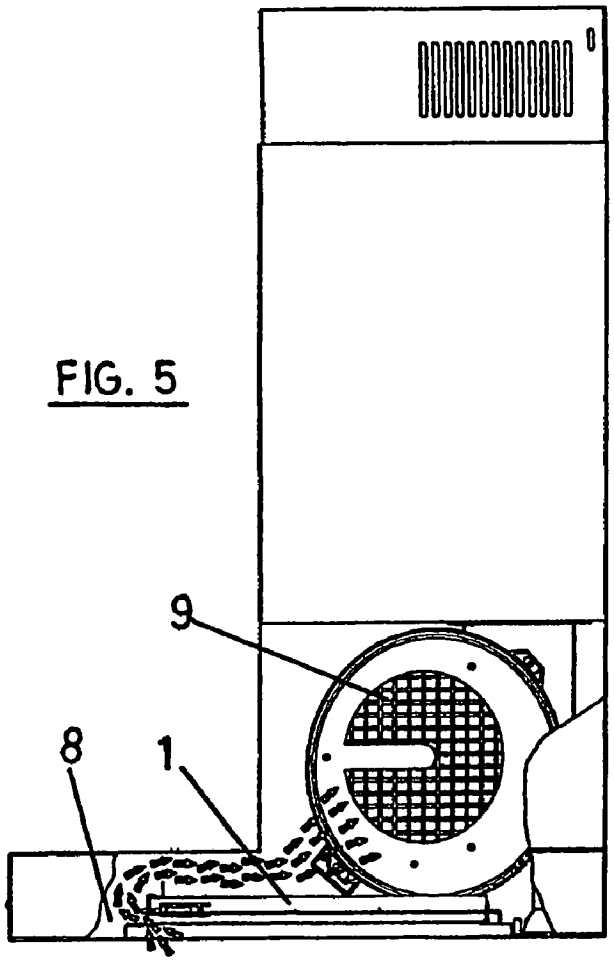

With this set up, as can be seen in the FIGS. 3 and 4, the panel 1 will be arranged within a fume extracting hood 7 in such way that its edges remain separated from the walls of said hood, delimitating with them some passages 8 through which the air is absorbed by the fan 9.

The panel 1 is arranged in a parallel position with respect to the inferior basis of the hood 7, being positioned-directly through the interior of the filter, in case it is carrying one.

With the commented set-up there practically cannot be impeded the intake of the air flow absorbed by the fan 9 and nevertheless the exterior of the hood is insulated from noise by the panel 1, as carrier of layer 6 of damping and noise absorbing material.

The invention claimed is:

1. A fume extracting hood comprising:

a housing (7) having an open interior surface, a filter mounted on the interior surface;

a fan power unit for absorption through said open surface, a removable silencer comprising:

a panel (1) including:

a lower tray (4);

an intermediary insulating sheet (5) and:

an upper layer of foamed or porous material (6);

wherein the panel is arranged inside the filter, and wherein the panel has a more reduced contour than the internal one of the hood, thereby staying separated from at least two of the walls of said hood, with which it determines some passages for the pass of air flow taken in by the fan.

2. A silencer for fume extracting hoods comprising:

a panel (1) having an intermediary insulating sheet (5) having opposite sides;

a lower tray (4) in direct contact with one of the sides of the insulating sheet; and an upper layer of foamed or porous material in direct contact with the other side of the intermediary insulating sheet;

wherein the panel has a smaller contour than the internal one of the hood (7);

wherein the silencer can be removed from the hood.

3. The silencer according to claim 2 wherein the panel has in one of its edges at least one hinge (2) for junction with the walls of the hood (7); wherein the remaining edges of the panel include at least one of the levers or fixing studs.

* * * * *